US005527123A

United States Patent [19]

Jackson et al.

[11] Patent Number: 5,527,123

[45] Date of Patent: Jun. 18, 1996

[54] MEDIA HANDLING IN AN INK-JET PRINTER

[75] Inventors: Larry A. Jackson; Bruce A. McFadden; Steve O. Rasmussen; Larry G. Neubauer, all of Vancouver, Wash.

[73] Assignee: Hewlett-Packard Company, Palo Alto, Calif.

[21] Appl. No.: 396,801

[22] Filed: Feb. 28, 1995

[51] Int. Cl.[6] ..... B41J 13/14

[52] U.S. Cl. ..... 400/642; 271/209

[58] Field of Search ..... 400/600, 600.4, 400/603, 603.1, 642, 647, 647.1; 271/209

[56] References Cited

U.S. PATENT DOCUMENTS 5,356,229 10/1994 Hickman et al. ..... 400/642
5,393,151 2/1995 Martin et al. .

OTHER PUBLICATIONS

HP Patent Application, S/N 08/057,364, Filed on Apr. 30, 1993 "Combined Central and Lateral Hold–Down Plates, and End–Of–Page Advance Decrease, In Liquid–Ink Printers".

HP Patent Application, S/N 08/056,229, File Apr. 30, 1993, "Imporved Media Control At Ink–Jet Print Zone".

*Primary Examiner*—John S. Hilten

[57] ABSTRACT

Described herein is a printer having a printhead which traverses laterally across a sheetlike print medium and which thereby defines a laterally-extending print zone across the print medium. A paper transport mechanism in the printer has drive rollers and associated pinch wheels to drive the print medium through the printer's print zone. The paper transport mechanism further includes an upper print media guide and a lower print medium guide. The two print medium guides are shaped at their transverse ends to bow the transverse edges of the print medium downwardly to reduce its tendency to buckle upwardly into the printhead. In order to fit the upper print medium guide into the limited available space above the drive rollers, it is made of a lower molded portion for paper contact and an upper backing portion for rigidity. A pinch finger extends toward the printer's print zone beyond the pinch wheels to establish a pinch point against the drive roller in near proximity to the print zone.

23 Claims, 4 Drawing Sheets

MEDIA HANDLING IN AN INK-JET PRINTER

FIELD OF THE INVENTION

This invention relates to components within a printer for supporting a print medium such as paper through the printer's print zone and for maintaining a desired separation between the print medium and the printer's printhead.

BACKGROUND OF THE INVENTION

One very significant challenge in the design of ink-jet printers is to provide reliable paper feeding and handling. While older printers commonly use tractor-feed mechanisms, newer printers are expected to feed individual sheets of paper. This is particularly difficult with ink-jet printing since it involves the application of liquid ink directly to the paper's surface. The portions of the paper having wet ink cannot be contacted without smearing the ink. Furthermore, to apply the ink there must be an open and accessible portion of the paper which is not obstructed by paper handling components. Since it is desired to print as closely as possible to the transverse edges of the paper, and since paper widths vary, it is undesirable or impractical to grip the paper by its edges as it is being printed.

The printhead of an ink-jet printer generally comprises a plurality of nozzles aligned along the longitudinal path of the paper. The printhead is carried above the print medium path and repeatedly traverses the paper between its transverse edges. After each transverse pass of the printhead, the paper is advanced longitudinally. The area covered by a single pass of the printhead is referred to as a print zone. In order to increase printing speeds, printheads are provided with larger numbers of nozzles. This in turn increases the longitudinal dimension of the print zone associated with the printheads. As print zones become larger, however, the problems in adequately supporting paper as it passes through the print zones become greater. For example, the upper surface of the paper cannot generally be contacted as it travels through the print zone or for a short length after the print zone in which applied ink might still be wet.

Another complicating factor is the effect wet ink has on paper. The application of wet ink has a tendency to make paper bow or buckle. This effect becomes more pronounced with larger print zones, since larger areas are subject to the presence of wet ink. However, bowing to any significant degree cannot be tolerated in a high-resolution ink-jet printer. Downward bowing, away from the printhead, decreases print accuracy. Upward bowing, toward the printhead, can cause the paper to hit the printhead and to smear any applied ink. Thus, it is very desirable but also very difficult to control the precise path of paper or other print media as it passes through the print zone of an ink-jet printer.

Ink-jet printers manufactured by Hewlett-Packard Company have provided paper control through the print zone with a combination of upper and lower print media guides as described in U.S. Pat. No. 5,356,229. Paper is driven into the print zone with one or more drive rollers and associated pinch wheels. The drive rollers establish a print medium path which starts beneath the rollers, continues up around the back of the rollers, and then continues over the top of the rollers and into the print zone. The lower print media guide supports the paper from below through the print zone. An upper print media guide, positioned just upstream from the print zone, contacts the paper from above before it enters the print zone. The positioning of the components is such that the drive rollers convey the paper first in a generally downward path toward the print zone. The upper print media guide contacts the upper surface of the paper and cooperates with the drive rollers to bias the paper downwardly. Downstream from the upper print media guide, the lower print media guide contacts the paper along a transverse line beneath the print zone and biases the paper upwardly, effectively establishing a concave shape in the paper relative to the print head. The paper is desirably contacted near the print zone only by the upper and lower print media guides, and only along longitudinally-spaced lines of contact.

This configuration has been, for the most part, quite successful. However, problems do remain. Some of these problems arise because of the limited available spaces near the print zone to locate components. For instance, the upper print media guide must be very precisely located as closely as possible to the print zone. However, the printer's carriage and printhead often overhang this area. Therefore, the upper print media guide must be thinner than might otherwise be desirable for economical production with acceptable manufacturing tolerances.

Another problem is that of positioning pinch wheels over the driver rollers. Such pinch wheels would desirably be positioned to contact the drive rollers at pinch points immediately adjacent the print zone so that accurate control over the paper's longitudinal position could be achieved even when feeding the very bottom of a paper sheet through the print zone. However, this is the location occupied by the upper print media guide. Furthermore, the physical diameter of the pinch wheels limits their proximity to the print zone. As a result, the pinch points established by the pinch wheels end up being significantly upstream of the print zone, thereby reducing the capability of the printer to print on the bottom margins of paper sheets.

Control over paper edges is another problem. Even though the concave shape of the paper through the print zone reduces its tendency to bow longitudinally, applying ink at the edges of paper often causes such edges to bow upwardly. This can interfere with the printhead and cause smearing.

SUMMARY OF THE INVENTION

The invention described below solves or reduces the seriousness of the paper-handling problems described above. In one aspect of the invention, an upper print media guide is formed of a molded plastic portion in combination with a metal backing plate. The plastic portion can be economically manufactured to provide desired contours and edges for paper contact and guidance, while the metal backing plate provides structural rigidity without significantly increasing the size of the print media guide. In another aspect of the invention, a pinch finger is provided to provide a pinch point over a drive roller which is closer to the print zone than can be attained with a pinch wheel. In another aspect of the invention, paper edge control is accomplished by providing a lower support edge along the upper print media guide which bends downwardly along its outer ends. This bows the paper edges downward and reduces their tendency to interfere with the printhead.

DESCRIPTION OF THE INVENTION

Figure 1:
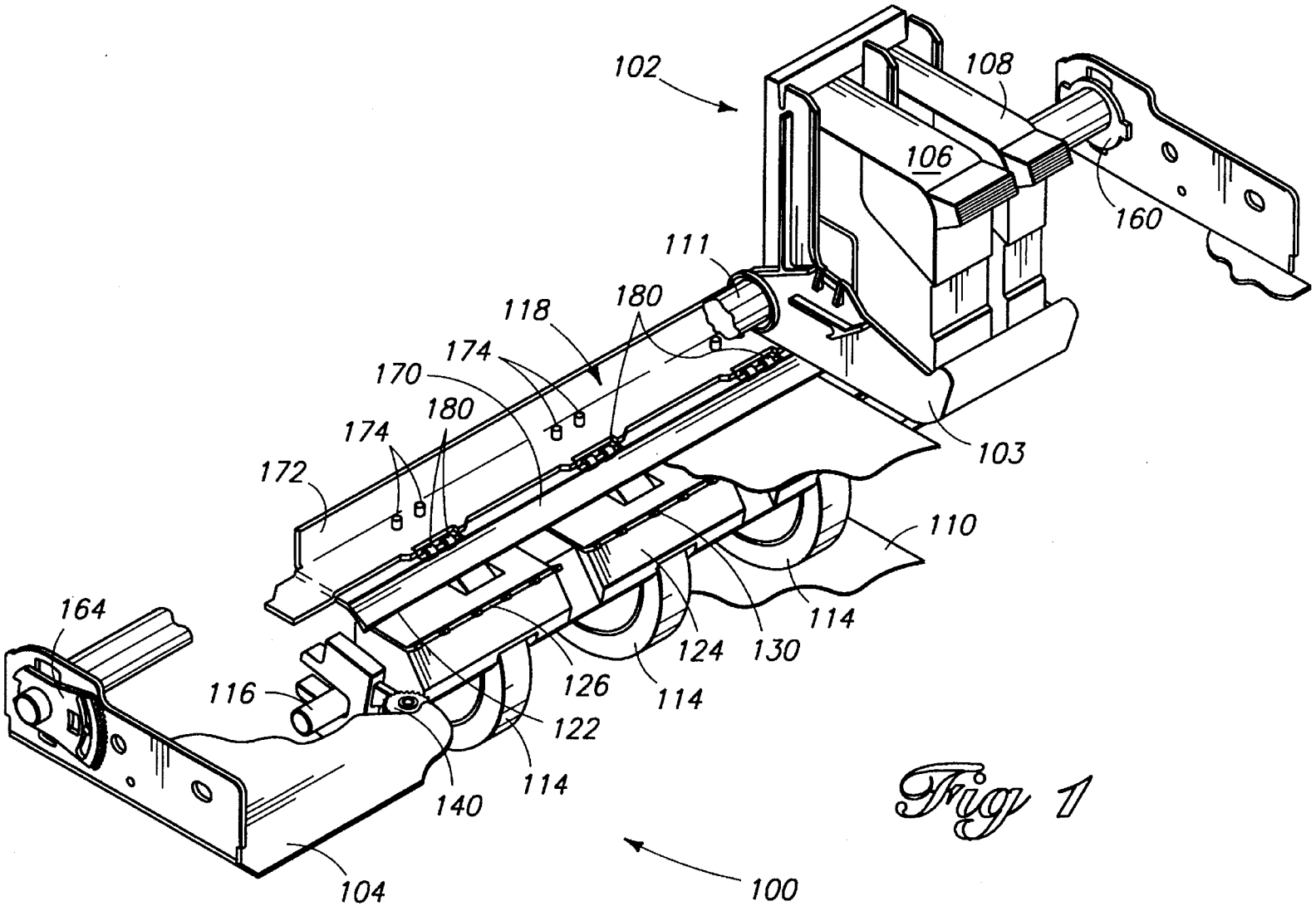
FIG. 1 is a top perspective view of a paper support and transport mechanism and associated carriage and printhead in accordance with a preferred embodiment of the invention.
Figure 2:
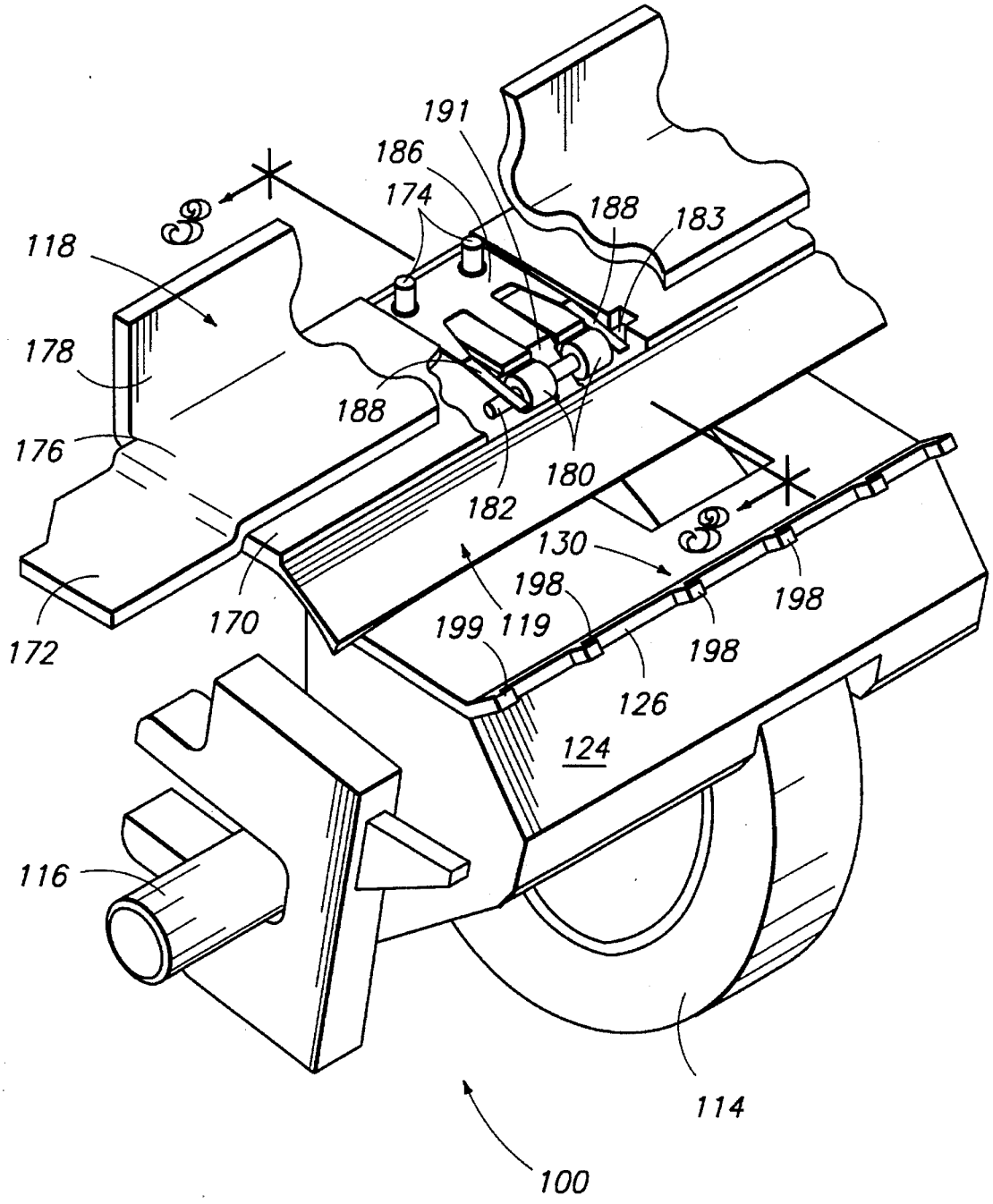
FIG. 2 is an enlarged top perspective view of a portion of the paper support and transport mechanism of FIG. 1, shown with portions of its upper print media guide broken away.

FIGS. 1–4 show a print media support mechanism 100 in accordance with a preferred embodiment of the invention for supporting paper or another print medium in a printer's print zone adjacent a printhead 102. It should be noted that although this specification repeatedly refers to "paper" and "paper" print media, the components described are also used to support other types of sheet-like media such as mylar, cardboard, envelopes, or transparencies. The term "paper" should be interpreted broadly to include such other types of sheet-like or paper-like media.

Paper support mechanism 100 and printhead 102 are mounted to a carriage plate 104 which has been broken away as necessary in the drawings to show the components discussed below. Carriage plate 104 is adapted to mount the components within a particular printer (not shown).

Printhead 102 is a color ink-jet assembly comprising a carriage 103 and a pair of cartridges 106 and 108. Carriage 103 traverses laterally across an underlying sheet 110 of paper or other sheetlike print medium carrying a color cartridge 106 and a black cartridge 108. Each cartridge has a plurality of nozzles (not shown) which are directed downwardly to deposit ink droplets on a top or upper surface of paper 110. Carriage 103 is supported vertically by a carriage rod 111. In operation, paper support mechanism 100 feeds paper 110 along a longitudinal print medium path beneath the printhead while the printhead repeatedly traverses laterally across the underlying paper, defining a laterally-extending print zone across the paper between its transverse edges. In the preferred embodiment: the print zone is approximately ½ inch in length. It is indicated generally by the dashed lines in FIG. 3.

Paper support mechanism 100 includes means for driving a print medium along an upstream to downstream print medium path through a print zone while also supporting paper 110 in the print zone adjacent printhead 102. In the preferred embodiment, such means includes at least one and preferably a plurality of drive rollers or drive roller tires 114 distributed laterally across the print medium path. Drive rollers 114 are mounted on a roller shaft 116 which has a longitudinal axis extending laterally or transversely across the width of the print medium path. Drive rollers 114 have rubber-like peripheries for frictional contact with paper 110 for driving paper 110 along the print medium path. Paper 110 enters the paper support mechanism beneath drive rollers 114, wraps upward and around the rollers, and exits the support mechanism at the top of the rollers after making an approximately 180° turn. Drive rollers 114 are driven through roller shaft 116 to rotate about the longitudinal axis of roller shaft 116. The drive rollers are mounted and positioned upstream of the print zone to feed or drive paper into and through the print zone.

Figure 3:
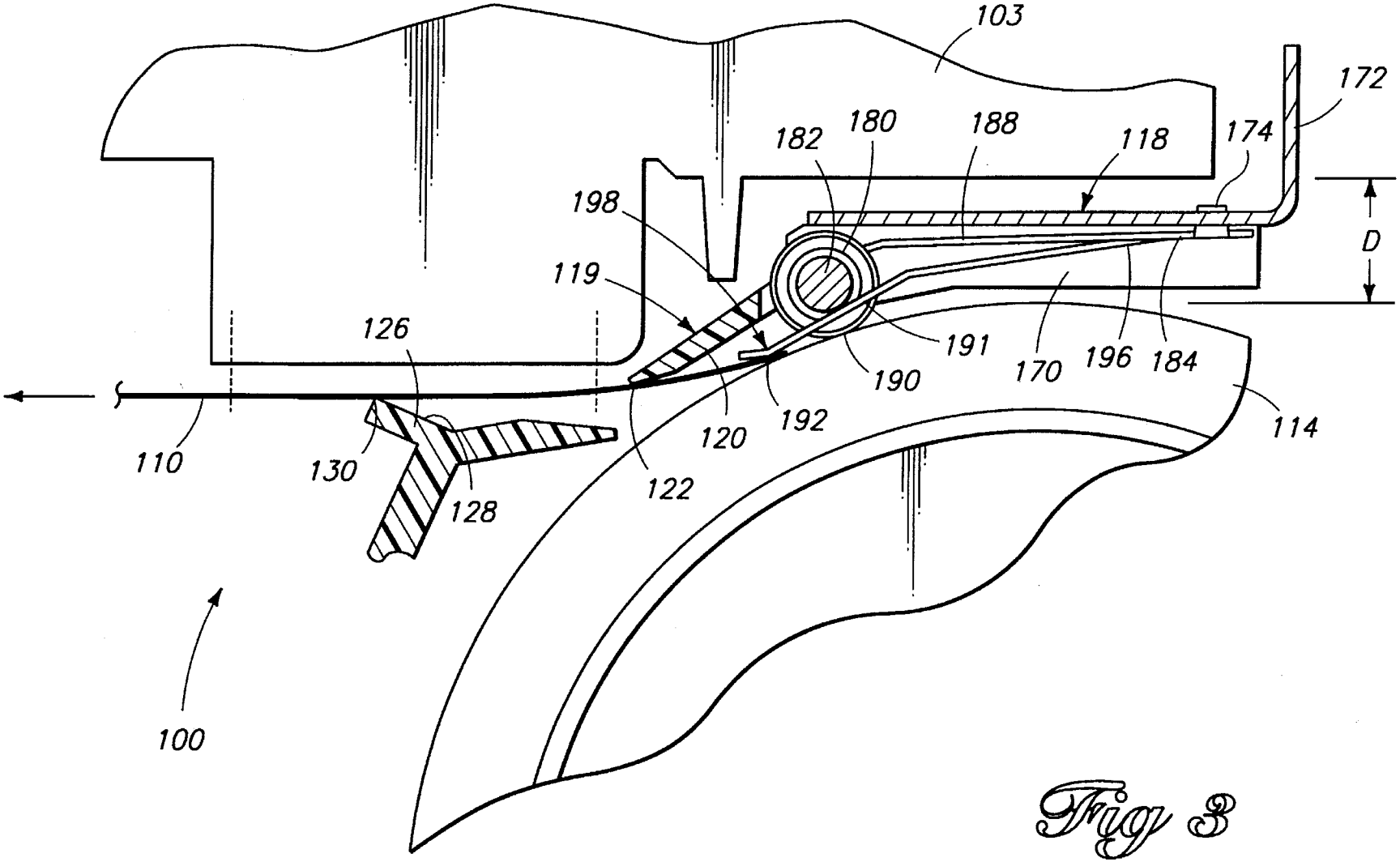
FIG. 3 is an enlarged cross-sectional view of the paper support and transport mechanism of FIG. 1, taken along line 3—3 of FIG. 2.

FIG. 3 illustrates the positional relationship between drive rollers 114 and printhead carriage 103. As can be seen, portions of carriage 103 traverse over the drive roller in close proximity to the drive roller, defining a very limited space between the carriage and the drive rollers.

An upper print media guide 118 is positioned in this limited space to support paper 110 from above. Upper print media guide 118 has an extending portion 119 which extends in a downward and downstream direction over paper 110 to contact paper 110 along a transverse line which is immediately upstream along the print medium path from the print zone, between the print zone and rollers 114. More specifically, upper print media guide 118 includes an inner surface 120 which inclines or slopes downwardly from horizontal in the downstream direction of the print medium path. Inner surface 120 terminates in a lower support edge 122 which extends over the upper surface of paper 110 and which contacts and supports paper 110 from above. Lower support edge 122 is somewhat below the top edge of rollers 114 so that paper 110 is forced into a downward path as it leaves rollers 114.

The upper print media guide in accordance with one aspect of this invention comprises two portions: a thin molded portion 170 of limited structural strength for contacting and guiding paper 110, and an upper metal backing plate or portion 172 of greater structural strength to support and rigidify the molded plastic portion. This construction allows lower portion 170 to be inexpensively molded from plastic to obtain a desired contoured shape for contacting, supporting, and guiding paper 110, and to have openings as needed to accommodate the drive roller and its associated parts. It would be expensive to machine these complex contour details from a stronger material such as metal. However, plastic does not provide sufficient rigidity to maintain desired tolerances while still maintaining the thinness required to fit the piece within the limited available space between carriage 103 and rollers 114. Because the piece is thin, it tends to bow from end to end when it is mounted or suspended across the width of an underlying sheet of paper. Metal backing portion 172 remedies this deficiency in a piece which can be inexpensively stamped and bent from sheet metal, providing accurate positioning of the complex contour details of the molded plastic portion. The two portions are ultrasonically welded together during manufacture, using rivets 174 which extend upward from molded portion 170 through corresponding apertures in backing portion 172. Metal portion 172 preferably includes a horizontal plate 176, to which molded portion 170 is mounted, and a rearward flange 178 which is bent at a right angle to horizontal plate 176 for adding even more strength to the structure and to eliminate any tendency of the upper print media guide to bow from end to end. Rearward flange 178 extends upwardly behind and out of the way of carriage 103.

Paper support mechanism 100 further includes at least one and preferably a plurality of pinch wheels 180 mounted in upper print media guide 118. The pinch wheels are arranged in pairs, with each pair being mounted on a common axle 182 (FIG. 2) which is oriented transversely with respect to the underlying paper. Each drive roller 114 has a corresponding pair of pinch wheels 180. Each axle includes opposite end portions which protrude transversely from opposite sides of each pair and which are received within upwardly-open slots 183 in the lower molded portion 170 of upper print media guide 118. Spring plates 184 are mounted within upper print media guide 118, sandwiched between its upper and lower portions, to bias the pinch wheels against their corresponding drive rollers. Each spring plate includes a rearward portion 186 having apertures through which rivets 178 are received to anchor the spring plate. Each spring plate furthermore has a pair of spring leaves 188 which extend from rearward portion 186 in a forward or downstream direction over the opposite end portions of a corresponding axle 182. The spring leaves are bent downwardly from horizontal to exert a downward biasing force through the pinch wheels on the underlying drive rollers 114.

Each pinch wheel is positioned to contact the print medium a first pinch point 190 near the print zone along the drive roller periphery upstream along the print medium path from lower support edge 122 of upper print medium guide 118. The purpose and function of the pinch wheels is to maintain frictional contact between the print medium and the drive roller periphery at first pinch points 190. Within the space and physical constraints of the overall assembly, the pinch wheels are located as closely as possible to the print zone to enable paper control as lowermost portions of paper 110 are being printed. However, the pinch wheels' diameters limit the proximity of the first pinch points to the print zone.

To enable printing nearer the bottom edge of paper 110, the preferred embodiment of the invention includes a pinch finger 191 corresponding to each drive roller 114. The pinch finger extends toward the print zone beneath upper print media guide 118 and beyond the pinch wheels. The pinch finger comprises an elongated leaf spring, alternatively described as a thin, flat, elongated plate of an elastic material such as spring steel. It is anchored at a proximal end 196 behind the corresponding drive roller and extends from there downstream along the print medium path to a distal portion or tip 198. More particularly, pinch finger 191 is formed by spring plate 184 between leaf springs 188. Its proximal end 196 is formed by rearward portion 186 of spring plate 184. Pinch finger 191 is thus supported by and extends from upper print media guide 118 from a point upstream along the print media path relative to pinch wheels 180. It is bent downwardly to extend between pinch wheels 180, beneath axle 182 of print wheels 180. The anchoring of the proximal end provides a torsioning force on the pinch finger which biases its distal portion or tip downward against the periphery of drive roller 114, to press paper 110 against the drive roller periphery at a second pinch point 192, and to maintain frictional contact between the drive roller and paper 110 at the second pinch point. The second pinch point at which distal portion or tip 198 contacts paper 110 is significantly closer to the print zone than first pinch points 190 created by the pinch wheels. This enables the paper to be controlled much closer to the print zone than was previously possible, and therefore allows printing much closer to the bottom edge of the paper.

Paper support mechanism 100 includes a pivot 124 which is mounted to pivot or rotate around roller shaft 116. Pivot 124 forms a lower print media guide 126 downstream from the upper print medium guide. Lower print medium guide 126 includes an upper surface 128 (labeled in FIG. 3) which inclines or slopes upwardly in the downstream paper direction at an adjustable angle from horizontal to an upper support edge 130 which extends laterally beneath paper 110. Upper support edge 130 is positioned to contact paper 110 along the print medium path downstream from lower support edge 122 of upper print media guide 118. Lower print media guide 126 pivots relative to the print zone between a non-retracted position (shown), and a retracted position (not shown). In the retracted position, pivot 124 is rotated approximately 65° (clockwise in the drawings) from the non-retracted position shown. In the nonretracted position, lower paper guide 126 contacts and supports paper 110 from below. Although not forming a part of the invention claimed herein, features of pivot 124 are described in a co-pending U.S. patent application assigned to Hewlett-Packard Company entitled "Paper Support Mechanism For Ink-Jet Printers," filed concurrently with this application, and incorporated by reference in this specification.

When pivot 124 is not retracted, drive rollers 114, lower edge 122, and upper support edge 130 work in combination to tension and control the elevation of paper 110 as it passes through the print zone. The print medium path extends in sequence (a) partially around and over the top of the drive rollers' peripheries, (b) between the drive rollers and the pinch wheels, (c) between the drive rollers and the distal ends of the pinch fingers, (d) away from the drive rollers, (e) beneath the lower support edge of the upper print media guide, and (f) over the upper support edge of the lower print media guide. Both lower support edge 122 and upper support edge 130 are below the uppermost elevation of the drive rollers. As paper 110 leaves drive rollers 114, it is forced downward by lower support edge 122. Upper support edge 130 is desirably slightly higher than lower edge 122. The relative positioning of the components forces paper 110 through first a downward path from driver roller 114 to lower edge 122, and then a slightly upward path from lower edge 122 to upper support edge 130. The print medium path is thus formed in a generally concave shape beneath and relative to the print zone.

In the preferred embodiment shown, upper support edge 130 is formed by a plurality of raised ribs 198 which are distributed and spaced across the lower print media guide. This feature is described in a co-pending patent application assigned to Hewlett-Packard Company, entitled "Print Medium Handling System Including Cockle Ribs to Control Pen-To-Print Medium Spacing During Printing," filed Feb. 28, 1994, and hereby incorporated by reference. The purpose of the ribs is to allow the supported paper to buckle slightly downward between the ribs. This relieves a degree of stress which is induced in the paper during high-density printing and thereby reduces the tendency of the paper to buckle upwardly and into the printhead.

The invention further includes means for bowing the print medium downwardly at each of its transverse edges in the print zone. It has been found that this reduces the tendency of the print medium transverse edges to bow or buckle upwardly and to thereby interfere with the printhead. In the preferred embodiment, this function is performed by inclining end portions of lower support edge 122 downwardly over the transverse edges of paper 110. More specifically, lower support edge 122 has a central segment and two end segments. The end segments are positioned over the transverse edges of the underlying paper. To bow the paper edges downwardly, the end segments are lower than the central segment. This can be seen most clearly in FIG. 4, which shows one side of lower support edge 122. As shown, in the preferred embodiment both the central segment and the end segments of the lower support edge are straight. However, the end segments (one of which is labeled with reference numeral 210 in FIG. 4) are angled downwardly from the central segment over the transverse edges of the paper to bow the edges of the paper.

The means for bowing the transverse edges of paper 110 further comprises modifications to upper support edge 130. Similarly to lower support edge 122, upper support edge 130 can be thought of as having a central segment and two end segments positioned beneath the transverse edges of paper 110, wherein the end segments are lower than the central segment to allow the paper to bow downwardly at its transverse edges in the print zone and to further reduce the tendency of the paper edges to interfere with the printhead.

Figure 4:
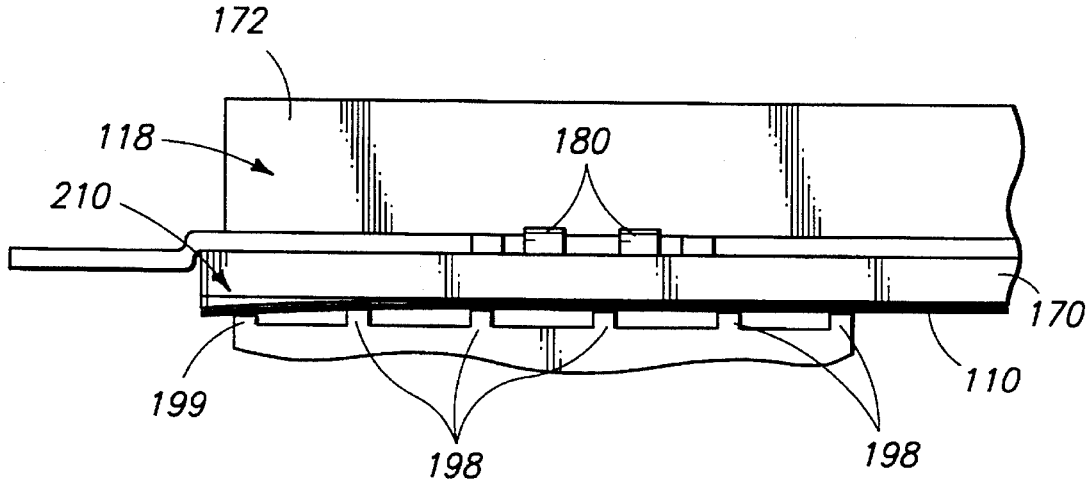
FIG. 4 is a partial and enlarged front view of a portion of the paper support and transport mechanism of FIG. 1.

In the preferred embodiment already described, the upper support edge is formed by raised ribs 198. These ribs include end ribs 199 (only one of which is visible in the drawings) toward each transverse end of the lower print media guide, positioned generally beneath the transverse edges of the paper. The lower positioning of the end segments in the lower print media guide is accomplished by positioning end ribs 199 lower than the rest of raised ribs 198 as shown in FIG. 4. As shown, paper 110 bows downwardly at its transverse edges because of the unique configuration and shape of upper and lower paper guides 118 and 126.

The invention includes both the system and components described above, as well as methodical steps of implementing the invention. For instance, the invention includes methodical steps of driving a print medium into a print zone of a printer and of supporting the print medium through the print zone beneath a printhead. Preferred methodical aspects of the invention include positioning a pinch wheel to contact the print medium at a first pinch point along a drive roller periphery near the print zone and biasing a pinch finger against the print medium at a second pinch point which is closer to the print zone than the first pinch point. Preferred methodical steps also include bowing the print medium downwardly at its transverse edges through the print zone. Further methodical aspects of the invention include constructing an upper paper guide as a two-piece assembly with a molded portion for paper contact and guidance and an upper backing portion for rigidity.

The invention results in significant improvements in paper control prior to and through a printer's print zone. Because of the pinch finger, paper control is maintained even when printing bottom margins of a sheet. Bowing outside edges of the paper through the print zone allows high-density printing to be performed on the paper edges without edge buckling. The unique upper print media guide construction allows the shape of the guide to be controlled and maintained very precisely which in turn increases the accuracy with which paper is positioned relative to the print zone.

In compliance with the statute, the invention has been described in language more or less specific as to structural and methodical features. It is to be understood, however, that the invention is not limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A printer comprising:

a printed which traverses laterally across a sheetlike print medium, the printed defining a laterally-extending print zone between the transverse edges of the print medium;

means for driving the print medium along a print medium path through the print zone;

means for bowing the print medium downwardly at each of its transverse edges in the print zone and for substantially reducing any tendency of the print medium transverse edges to interfere with the printhead.

2. A printer comprising:

a printhead which traverses laterally across a sheetlike print medium, the print medium having transverse edges which tend to curl upwardly and interfere with the printhead, the printhead defining a laterally-extending print zone between the transverse edges of the print medium;

at least one drive roller having a periphery for frictional contact with the print medium to drive the print medium along a print medium path through the print zone;

the print medium path extending partially around and over the top of the drive roller and then away from the drive roller periphery through the print zone;

an upper print media guide having a lower support edge extending over the print medium, the lower support edge being positioned to contact the print medium between the drive roller and the print zone, the lower support edge having a central segment and two end segments, the end segments being positioned over the transverse edges of the print medium;

the end segments of the lower support edge being lower than the central segment of the lower support edge to bow the print medium downwardly at each of its transverse edges as it enters the print zone and to thereby reduce the tendency of the print medium transverse edges to interfere with the printhead.

3. A printer as recited in claim 2 and further comprising a pinch finger supported by the upper print media guide to extend toward the print zone, the pinch finger having a distal tip which is biased against the drive roller to maintain frictional contact between the drive roller and the print medium.

4. A printer as recited in claim 2 and further comprising:

at least one pinch wheel mounted in the upper print media guide, the pinch wheel being biased against the drive roller to maintain frictional contact between the drive roller and the print medium at a first pinch point, the pinch wheel having a diameter which limits the proximity of the first pinch point to the print zone;

a pinch finger supported by the upper print media guide to extend toward the print zone beyond the pinch wheel, the pinch finger having a distal tip which is biased against the drive roller to maintain frictional contact between the drive roller and the print medium at a second pinch point which is closer to the print zone than the first pinch point.

5. A printer as recited in claim 2, the upper print media guide comprising a molded plastic portion of limited structural strength for contacting and guiding the print medium and an upper metal backing portion of greater structural strength to support and rigidify the molded plastic portion.

6. A printer as recited in claim 2 wherein the end segments of the upper support edge are angled downwardly from the central segment.

7. A printer as recited in claim 2 wherein the central segment is straight and the end segments are angled downwardly from the central segment.

8. A printer as recited in claim 2 wherein the central segment and the end segments are straight, and wherein the end segments are angled downwardly from the central segment.

9. A printer as recited in claim 2 wherein the lower support edge is positioned to contact the print medium along the print medium path immediately adjacent the print zone.

10. A printer as recited in claim 2 and further comprising: a lower print media guide forming an upper support edge laterally beneath the print medium, the upper support edge having a central segment and two end segments, the end segments being positioned beneath the transverse edges of the print medium;

the end segments of the upper support edge being lower than the central segment of the upper support edge to allow the print medium to bow downwardly at its transverse edges in the print zone and to further reduce the tendency of the print medium transverse edges to interfere with the printhead.

11. A printer as recited in claim 2 and further comprising:

a lower print media guide forming an upper support edge laterally beneath the print medium, the upper support edge having a central segment and two end segments, the end segments being positioned beneath the transverse edges of the print medium;

the end segments of the upper support edge being lower than the central segment of the upper support edge to allow the print medium to bow downwardly at its transverse edges in the print zone and to further reduce the tendency of the print medium transverse edges to interfere with the printhead;

the upper support edge being formed by a plurality of raised ribs distributed across the lower print media guide.

12. A printer as recited in claim 2 and further comprising:

a lower print media guide extending laterally beneath the print medium;

a plurality of raised ribs distributed across the lower print media guide to contact the print medium downstream from the lower support edge of the upper print media guide, said plurality of raised ribs including an end rib toward each transverse end of the lower print media guide, the end ribs being positioned generally beneath the transverse edges of the print medium;

the end ribs being lower than the rest of the raised ribs to allow the print medium to bow downwardly at its transverse edges in the print zone and to thereby reduce the tendency of the print medium transverse edges to interfere with the printhead.

13. A method of supporting a print medium through a print zone of a printer beneath the printer's printhead, the print medium having transverse edges which tend to curl upwardly and interfere with the printhead, the method comprising the following steps:

driving the print medium into the print zone;

bowing the print medium downwardly at its transverse edges through the print zone and substantially reducing the tendency of the print medium transverse edges to interfere with the printhead.

14. A method of supporting a print medium through a print zone of a printer beneath the printer's printhead, the print medium having transverse edges which tend to curl upwardly and interfere with the printhead, the method comprising the following steps:

supporting the print medium from above with a lower support edge positioned immediately upstream along a print medium path from the print zone, the lower support edge having a central segment and two end segments, the end segments being positioned over the transverse edges of the print medium;

lowering the end segments of the lower support edge relative to the central segment to bow the print medium downwardly at each of its transverse edges as it enters the print zone and to thereby reduce the tendency of the print medium transverse edges to interfere with the printhead.

15. A method as recited in claim 14 and further comprising:

supporting the print medium from below with an upper support edge positioned along the print medium path downstream from the lower support edge, the upper support edge having a central segment and two end segments, the end segments of the upper support edge being positioned beneath the transverse edges of the print medium;

lowering the end segments of the upper support edge relative to the central segment to bow the print medium downwardly at each of its transverse edges as it extends through the print zone and to thereby reduce the tendency of the print medium transverse edges to interfere with the printhead.

16. A printer comprising:

a printhead which traverses laterally across a sheetlike print medium, the printhead defining a laterally-extending print zone across the print medium;

at least one drive roller having a periphery for frictional contact with the print medium to drive the print medium along a print medium path through the print zone, the print medium path extending partially around and over the top of the drive roller and then away from the drive roller periphery through the print zone;

wherein portions of the printhead traverse over the drive roller and define a limited space between the printhead and the drive roller;

an upper print media guide positioned in the limited space above the drive roller, the upper print media guide having a lower support edge extending over the print medium to contact and guide the print medium between the drive roller and the print zone;

the upper print media guide comprising a molded plastic portion of limited structural strength and an upper metal backing portion of greater structural strength to support and rigidify the molded plastic portion in the limited space above the drive roller, the molded plastic portion allowing the upper print media guide to have complex contour details as needed to contact and guide the print medium and to accommodate the drive roller and its associated parts, the upper metal backing portion providing accurate positioning of the complex contour details of the molded plastic portion.

17. A printer as recited in claim 16 and further comprising at least one pinch wheel mounted in the upper print media guide, the pinch wheel being biased against the drive roller to maintain frictional contact between the drive roller and the print medium, the molded plastic portion having openings for said at least one pinch wheel.

18. A printer as recited in claim 16 and further comprising a pinch finger supported by the upper print media guide to extend toward the print zone, the pinch finger having a distal tip which is biased against the drive roller to maintain frictional contact between the drive roller and the print medium.

19. A printer as recited in claim 16 and further comprising:

at least one pinch wheel mounted in the upper print media guide, the pinch wheel being biased against the drive roller to maintain frictional contact between the drive roller and the print medium at a first pinch point;

a pinch finger extending toward the print zone beyond the pinch wheel, the pinch finger having a distal tip which is biased against the drive roller to maintain frictional contact between the drive roller and the print medium at a second pinch point which is closer to the print zone than the first pinch point;

the pinch finger being formed from a spring plate which is sandwiched between the molded plastic portion and the upper metal backing portion.

20. A printer as recited in claim 16 and further comprising:

at least one pinch wheel mounted in the upper print media guide, the pinch wheel being biased against the drive roller to maintain frictional contact between the drive roller and the print medium at a first pinch point;

a pinch finger supported by the upper print media guide to extend toward the print zone beyond the pinch wheel, the pinch finger having a distal tip which is biased against the drive roller to maintain frictional contact between the drive roller and the print medium at a second pinch point which is closer to the print zone than the first pinch point.

21. A printer as recited in claim 16 and further comprising:

at least one pinch wheel mounted in the upper print media guide;

a leaf spring which biases the pinch wheel against the drive roller to maintain frictional contact between the drive roller and the print medium at a first pinch point;

a pinch finger extending toward the print zone beyond the pinch wheel, the pinch finger having a distal tip which is biased against the drive roller to maintain frictional contact between the drive roller and the print medium at a second pinch point which is closer to the print zone than the first pinch point;

the leaf spring and the pinch finger being formed from a common spring plate which is sandwiched between the molded plastic portion and the upper metal backing portion.

22. A printer as recited in claim 16 wherein:

the print medium has transverse edges which tend to bow upwardly and interfere with the printhead;

the lower support edge of the upper print media guide has a central segment and two end segments, the end segments being positioned over the transverse edges of the print medium;

the end segments are lower than the central segment to bow the print medium downwardly at its transverse edges and to thereby reduce the tendency of the print medium transverse edges to interfere with the printhead.

23. A printer as recited in claim 16 wherein:

the print medium has transverse edges which tend to bow upwardly and interfere with the printhead;

the lower support edge of the upper print media guide has a central segment and two end segments, the end segments being positioned over the transverse edges of the print medium;

the end segments are lower than the central segment to bow the print medium downwardly at its transverse edges and to thereby reduce the tendency of the print medium transverse edges to interfere with the printhead;

the printer further comprising a lower print media guide forming an upper support edge laterally beneath the print medium, the upper support edge having a central segment and two end segments, the end segments of the upper support edge being positioned beneath the transverse edges of the print medium;

the end segments of the upper support edge are lower than the central segment of the upper support edge to allow the print medium to bow downwardly at its transverse edges in the print zone and to further reduce the tendency of the print medium transverse edges to interfere with the printhead.

* * * * *